US006237148B1

(12) United States Patent
Graham

(10) Patent No.: US 6,237,148 B1
(45) Date of Patent: May 29, 2001

(54) THUMB SHIELDING DEVICE

(76) Inventor: Margaret C. Graham, 504 Capitol Heights Blvd., Capitol Heights, MD (US) 20743

( * ) Notice: Subject to any disclaimer, the term of this patent is extended or adjusted under 35 U.S.C. 154(b) by 0 days.

(21) Appl. No.: 09/528,270

(22) Filed: Mar. 17, 2000

(51) Int. Cl.[7] ..... A41D 13/08; D05B 91/04
(52) U.S. Cl. ..... 2/21; 223/101
(58) Field of Search ..... 2/21, 2.5, 455, 2/163, 164, 167, 161.1; 602/22; 128/880; 223/101; 132/73

(56) References Cited

U.S. PATENT DOCUMENTS

| | | | | |
|---|---|---|---|---|
| D. 373,225 | | 8/1996 | Theroux et al. . | |
| 2,070,506 | | 8/1937 | Bevill . | |
| 3,531,029 | * | 9/1970 | Lee | 223/101 |
| 3,728,736 | * | 4/1973 | Pugh | 2/21 |
| 4,507,804 | | 4/1985 | Consigny . | |
| 4,681,012 | * | 7/1987 | Stelma et al. | 2/163 |
| 4,796,302 | * | 1/1989 | Davis et al. | 2/21 |
| 4,867,246 | * | 9/1989 | Kiger | 2/161.1 |
| 4,908,881 | * | 3/1990 | Field | 2/21 |
| 5,450,626 | | 9/1995 | Sorrels . | |
| 5,517,692 | | 5/1996 | Wunderlich-Kehm . | |
| 5,554,076 | * | 9/1996 | Clark | 2/21 |
| 5,609,165 | * | 3/1997 | Lambert | 2/163 |
| 5,765,731 | | 6/1998 | Callian . | |

* cited by examiner

*Primary Examiner*—John J. Calvert
*Assistant Examiner*—Tejash Patel

(57) ABSTRACT

A thumb shielding device for protecting a user's thumbs from nicks and cuts when the user is preparing foods with sharp kitchen utensils. The thumb shielding device includes a substantially cut-proof planar member. The planar member has a ridged central portion and a pair of malleable flaps. Each flap extends outward from an associated side of the central portion. The flaps are designed to bend around a thumb of a user thereby securing the planar member around the user's thumb. In addition, the thumb shielding device may comprise a generally cylindrical substantially cut-proof sheath that is designed to snugly cover a thumb of a user. The sheath has an open end, a closed end, and an interior. A lining is coupled to the interior of the sheath for facilitating engagement of the sheath to the thumb of the user.

8 Claims, 2 Drawing Sheets

THUMB SHIELDING DEVICE

BACKGROUND OF THE INVENTION

1. Field of the Invention

The present invention relates to finger protecting devices and more particularly pertains to a new thumb shielding device for protecting a user's thumbs from nicks and cuts when the user is preparing foods with sharp kitchen utensils.

2. Description of the Prior Art

The use of finger protecting devices is known in the prior art. More specifically, finger protecting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,070,506; U.S. Pat. No. 5,450,626; U.S. Pat. No. Des. 373,225; U.S. Pat. No. 5,765,731; U.S. Pat. No. 4,507,804; and U.S. Pat. No. 5,517,692.

While these devices fulfill their respective, particular objectives and requirements, the aforementioned patents do not disclose a new thumb shielding device. The inventive device includes a substantially cut-proof planar member. The planar member has a ridged central portion and a pair of malleable flaps. Each flap extends outward from an associated side of the central portion. The flaps are designed to bend around a thumb of a user thereby securing the planar member around the user's thumb. In addition, the thumb shielding device may comprise a generally cylindrical substantially cut-proof sheath that is designed to snugly cover a thumb of a user. The sheath has an open end, a closed end, and an interior. A lining is coupled to the interior of the sheath for facilitating engagement of the sheath to the thumb of the user.

In these respects, the thumb shielding device according to the present invention substantially departs from the conventional concepts and designs of the prior art, and in so doing provides an apparatus primarily developed for the purpose of protecting a user's thumbs from nicks and cuts when preparing foods.

SUMMARY OF THE INVENTION

In view of the foregoing disadvantages inherent in the known types of finger protecting devices now present in the prior art, the present invention provides a new thumb shielding device construction wherein the same can be utilized for protecting a user's thumbs from nicks and cuts when the user is preparing foods with sharp kitchen utensils.

The general purpose of the present invention, which will be described subsequently in greater detail, is to provide a new thumb shielding device apparatus and method which has many of the advantages of the finger protecting devices mentioned heretofore and many novel features that result in a new thumb shielding device which is not anticipated, rendered obvious, suggested, or even implied by any of the prior art finger protecting devices, either alone or in any combination thereof.

To attain this, the present invention generally comprises a substantially cut-proof planar member. The planar member has a ridged central portion and a pair of malleable flaps. Each flap extends outward from an associated side of the central portion. The flaps are designed to bend around a thumb of a user thereby securing the planar member around the user's thumb. In addition, the thumb shielding device may comprise a generally cylindrical substantially cut-proof sheath that is designed to snugly cover a thumb of a user. The sheath has an open end, a closed end, and an interior. A lining is coupled to the interior of the sheath for facilitating engagement of the sheath to the thumb of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new thumb shielding device apparatus and method which has many of the advantages of the finger protecting devices mentioned heretofore and many novel features that result in a new thumb shielding device which is not anticipated, rendered obvious, suggested, or even implied by any of the prior art finger protecting devices, either alone or in any combination thereof.

It is another object of the present invention to provide a new thumb shielding device that may be easily and efficiently manufactured and marketed.

It is a further object of the present invention to provide a new thumb shielding device that is of a durable and reliable construction.

An even further object of the present invention is to provide a new thumb shielding device which is susceptible of a low cost of manufacture with regard to both materials and labor, and which accordingly is then susceptible of low prices of sale to the consuming public, thereby making such thumb shielding device economically available to the buying public.

Still yet another object of the present invention is to provide a new thumb shielding device which provides in the apparatuses and methods of the prior art some of the advantages thereof, while simultaneously overcoming some of the disadvantages normally associated therewith.

Still another object of the present invention is to provide a new thumb shielding device for protecting a user's thumbs from nicks and cuts when the user is preparing foods with sharp kitchen utensils.

Yet another object of the present invention is to provide a new thumb shielding device which includes a substantially cut-proof planar member. The planar member has a ridged central portion and a pair of malleable flaps. Each flap extends outward from an associated side of the central portion. The flaps are designed to bend around a thumb of a user thereby securing the planar member around the user's thumb. In addition, the thumb shielding device may comprise a generally cylindrical substantially cut-proof sheath that is designed to snugly cover a thumb of a user. The sheath has an open end, a closed end, and an interior. A lining is coupled to the interior of the sheath for facilitating engagement of the sheath to the thumb of the user.

Still yet another object of the present invention is to provide a new thumb shielding device that is easy to use.

Even still another object of the present invention is to provide a new thumb shielding device that is lightweight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
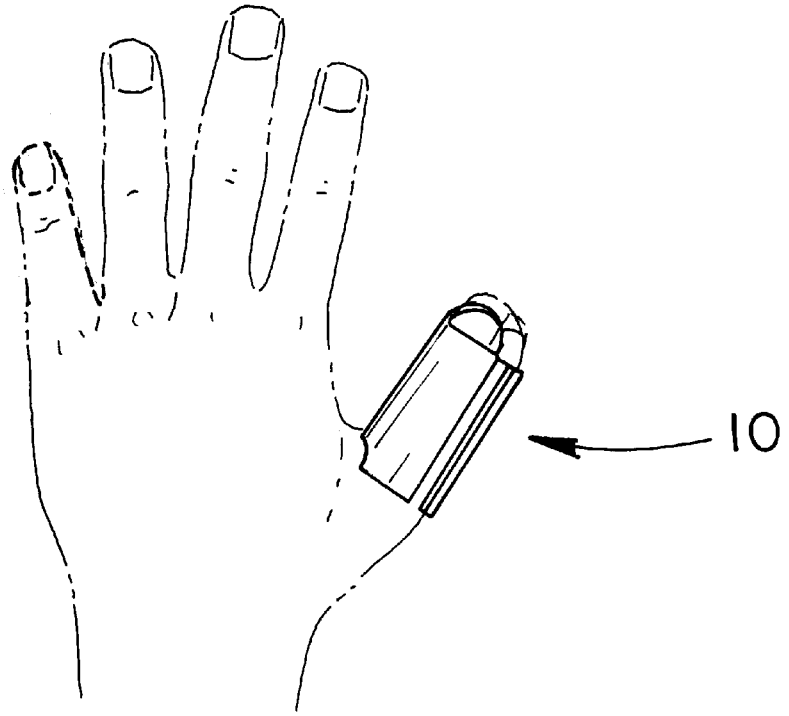
FIG. 1 is a schematic top view of a new thumb shielding device according to the present invention, illustrating the cut-proof planar member and flaps design being engaged on the thumb of a user.
Figure 2:
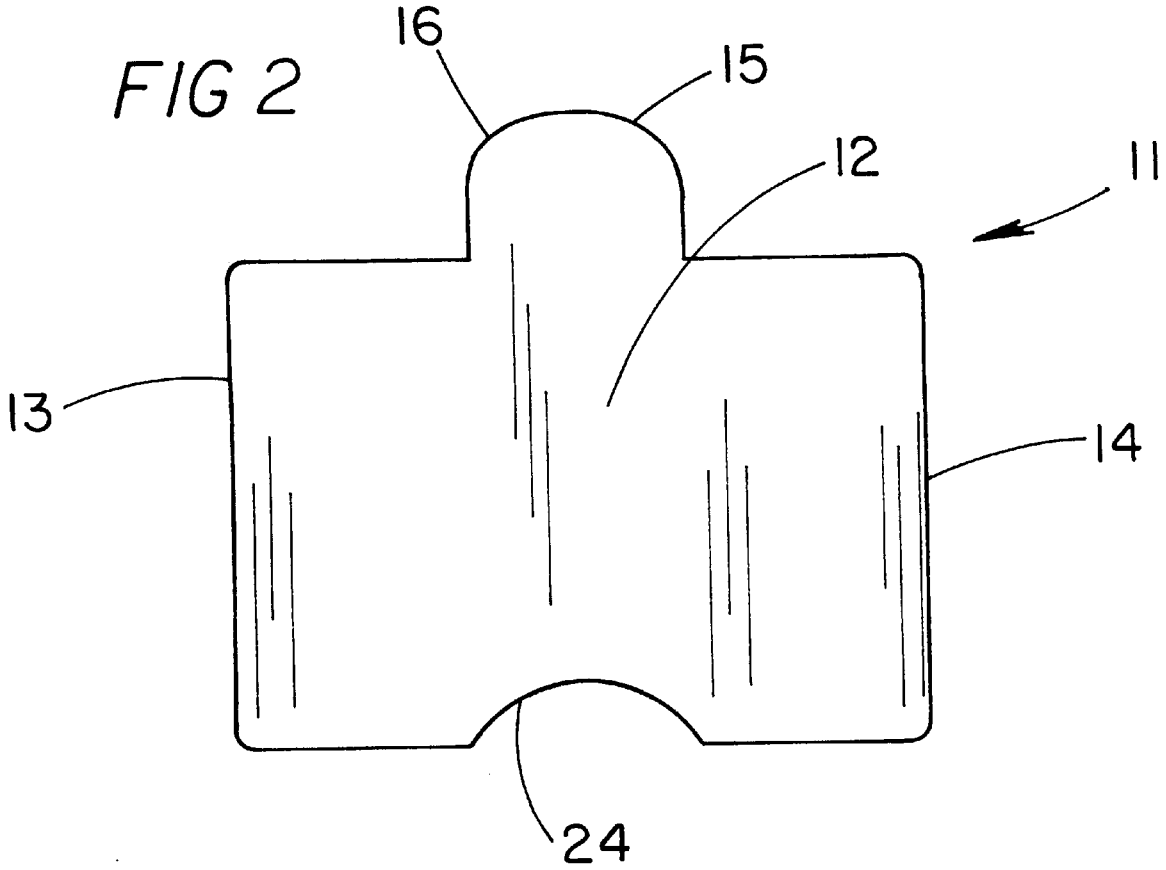
FIG. 2 is a schematic top view of the cut-proof planer member design of the present invention.
Figure 3:
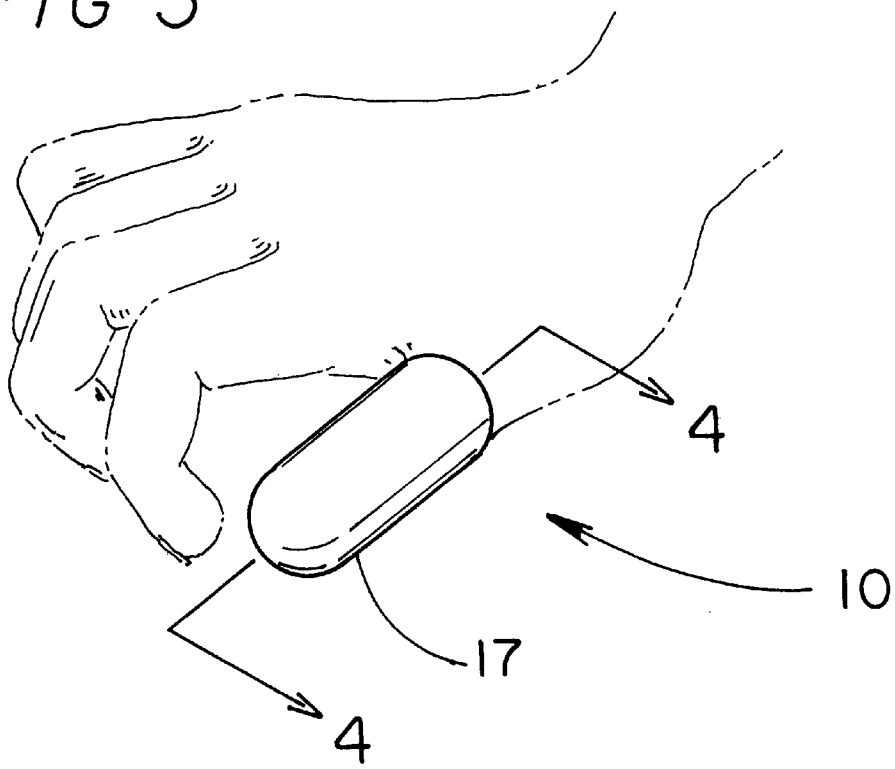
FIG. 3 is a schematic perspective view of a new thumb shielding device according to the present invention, illustrating the cut-proof sheath design being engaged on the thumb of a user.
Figure 4:
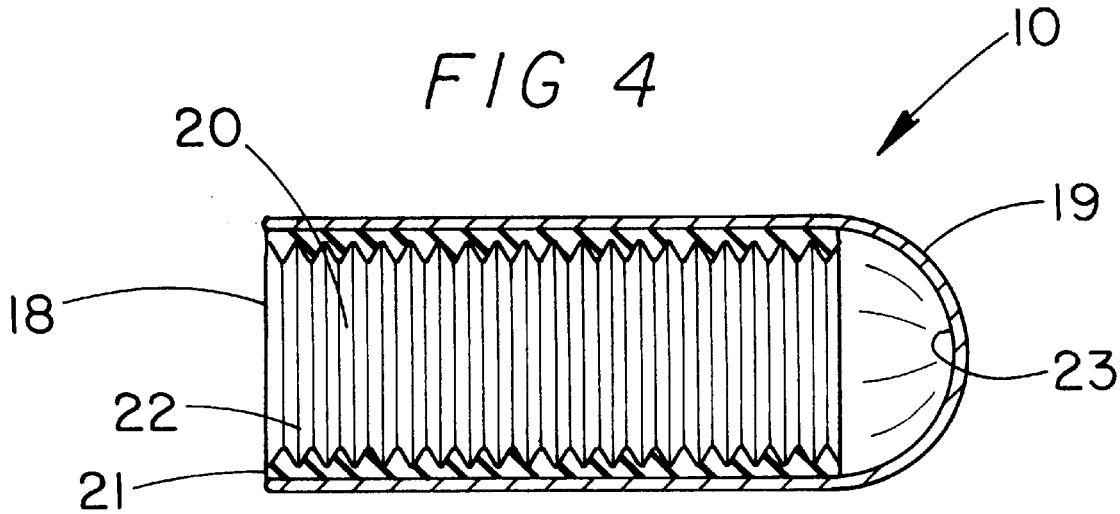
FIG. 4 is a schematic cross-sectional view of the sheath design of the present invention.

With reference now to the drawings, and in particular to FIGS. 1 through 6 thereof, a new thumb shielding device embodying the principles and concepts of the present invention and generally designated by the reference numeral 10 will be described.

As best illustrated in FIGS. 1 through 6, the thumb shielding device 10 generally comprises a substantially cut-proof planar member 11. The planar member 11 has a central portion 12 and a pair of flaps 13, 14. Each flap 13, 14 extends outward from an associated side of the central portion 12. The central portion 12 is made from material that is substantially rigid. Each of the flaps 13, 14 are made from material that is substantially malleable. The flaps 13, 14 bend around a thumb of a user securing the planar member 11 around the user's thumb. The planar member 11 generally covers the thumb thereby preventing the thumb from being cut.

The central portion 12 of the thumb shielding device 10 has an arcuate cutout portion 24 that extends between opposite lower ends of the flaps 13, 14. The arcuate cutout portion 24 is positioned proximate a base of the thumb of the user when the planar member 11 is secured to the thumb of the user. The arcuate cutout portion 24 facilitates the bending of a joint at the base of the thumb.

The central portion 12 of the thumb shielding device 10 also has a protrusion 15 that extends outward from opposite upper ends of the flaps 13, 14. The protrusion 15 is positioned adjacent a thumbnail of the thumb of the user when the planar member 11 is secured to the user's thumb. The protrusion 15 is used for covering a distal end of the thumb of the user.

The protrusion 15 has a distal edge 16 that is arcuate. The distal edge 16 generally conforms to an outline of the thumb of the user and is used for facilitating the holding of items being cut during use.

In addition, the thumb shielding device 10 may be designed to comprise a generally cylindrical substantially cut-proof sheath 17. The sheath 17 has an open end 18, a closed end 19, and an interior 20. The sheath 17 is designed to snugly cover a thumb of a user. The sheath 18 is made of a material chosen from the group of materials consisting of copper, brass, and sterling silver.

A lining 21 that is made of rubber is coupled to the interior of the sheath 17. The lining 21 includes a plurality of resilient circumferential grooves 22 along a length of the sheath 17. The lining 21 facilitates the engagement of the sheath 17 to the thumb of the user.

The closed end 19 is generally dome-shaded and is used to position an interior surface 23 of the closed end 19 in a spaced relationship to a thumbnail of the thumb of the user. The closed end 19 prevents contact between the inner surface 23 of the closed end 19 and the thumbnail of the thumb when the sheath 17 is engaged to the thumb.

In use, the design with the malleable flaps 13, 14 is engaged on the thumb of a user by placing the central portion 12 of the thumb shielding device 10 adjacent to the thumb of the user and then bending the flaps 13, 14 around the user's thumb. The sheath design is engaged on the thumb of a user simply by sliding the user's thumb into the interior 20 of the sheath 17. Once the thumb shielding device 10 is engaged on the user's thumb the user can use sharp kitchen utensils to prepare food without cutting his or her thumb.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A thumb shielding device comprising:

a substantially cut-proof planar member, said planar member having a central portion and a pair of flaps, each flap extending outwardly from an associated side of said central portion;

wherein said central portion is substantially rigid;

wherein each flap is substantially malleable for permitting bending of said flaps around a thumb of a user for securing said planar member around the thumb of the user whereby said planar member generally covers said thumb for preventing cutting of said thumb; and said central portion having an arcuate cutout portion extending between opposite lower ends of said flaps such that said arcuate cutout portion is positionable proximate a base of the thumb of the user when said planar member is secured to the thumb of the user, said arcuate cutout portion being for facilitating bending of a joint at the base of the thumb.

2. A thumb shielding device comprising:

a substantially cut-proof planar member, said planar member having a central portion and a pair of flaps, each flap extending outwardly from an associated side of said central portion;

wherein said central portion is substantially rigid;

wherein each flap is substantially malleable for permitting bending of said flaps around a thumb of a user for securing said planar member around the thumb of the user whereby said planar member generally covers said thumb for preventing cutting of said thumb; and said central portion having a protrusion extending outwardly from opposite upper ends of said flaps such that said protrusion is positionable adjacent a thumbnail of the thumb of the user when said planar member is secured to the thumb of the user, said protrusion being for covering a distal end of the thumb of the user.

3. The thumb shielding device of claim 2, further comprising:

a distal edge of said protrusion being arcuate for generally conforming to an outline of the thumb of the user for facilitating holding of items being cut during use.

4. A thumb shielding device comprising:

a generally cylindrical substantially cut-proof sheath having an open end, a closed end, and an interior;

said sheath being adapted for snugly covering a thumb of a user; and a lining coupled to said interior of said sheath for facilitating engagement of said sheath to the thumb of the user; and said lining including a plurality of resilient circumferential grooves along a length of said sheath, said grooves being for facilitating holding of the thumb in said sheath.

5. The thumb shielding device of claim 4 wherein said lining is made of rubber.

6. The thumb shielding device of claim 4 wherein said sheath is made of a material chosen from the group of materials consisting of copper, brass, and sterling silver.

7. The thumb shielding device of claim 4, further comprising:

said closed end being generally dome-shaped for positioning an interior surface of said closed end in spaced relationship to a thumbnail of the thumb of the user for preventing contact between said inner surface of said closed end and the thumbnail of the thumb when said sheath is engaged to the thumb.

8. A thumb shielding device comprising:

a generally cylindrical substantially cut-proof sheath having an open end, a closed end, and an interior;

said sheath being adapted for snugly covering a thumb of a user;

a lining coupled to said interior of said sheath for facilitating engagement of said sheath to the thumb of the user;

said lining including a plurality of resilient circumferential grooves along a length of said sheath, said grooves being for facilitating holding of the thumb in said sheath;

wherein said lining is made of rubber;

wherein said sheath is made of a material chosen from the group of materials consisting of copper, brass, and sterling silver; and said closed end being generally dome-shaped for positioning an interior surface of said closed end in spaced relationship to a thumbnail of the thumb of the user for preventing contact between said inner surface of said closed end and the thumbnail of the thumb when said sheath is engaged to the thumb.

* * * * *